US007906719B2

(12) United States Patent
Seymour

(10) Patent No.: US 7,906,719 B2
(45) Date of Patent: Mar. 15, 2011

(54) PRACTICE DRUMSTICK

(76) Inventor: Charles Francis Seymour, Chisago City, MN (US)

( * ) Notice: Subject to any disclaimer, the term of this patent is extended or adjusted under 35 U.S.C. 154(b) by 741 days.

(21) Appl. No.: 11/235,502

(22) Filed: Sep. 26, 2005

(65) Prior Publication Data

US 2007/0068363 A1 Mar. 29, 2007

(51) Int. Cl.
*G10D 13/02* (2006.01)

(52) U.S. Cl. ..... 84/422.4

(58) Field of Classification Search ..... 84/422.4
See application file for complete search history.

(56) References Cited

U.S. PATENT DOCUMENTS 4,114,503 A * 9/1978 Petillo ..... 84/422.4
5,170,001 A 12/1992 Amendola
5,179,237 A * 1/1993 Grossman ..... 84/422.4
5,361,671 A 11/1994 Genna
5,666,796 A * 9/1997 Korthuis ..... 56/330
5,728,958 A * 3/1998 Vater ..... 84/422.4
6,138,791 A * 10/2000 Zanzie ..... 181/252
2001/0035085 A1 * 11/2001 Broome et al. ..... 84/422.4
2004/0244563 A1 12/2004 Calato

OTHER PUBLICATIONS

US 5,602,235, 1/1996, Lipp (withdrawn).

* cited by examiner

*Primary Examiner* — Kimberly R Lockett
(74) *Attorney, Agent, or Firm* — Roger Belfay

(57) ABSTRACT

The practice drumstick comprises an inner core and an outer sheath. The outer sheath is constructed of a material or materials suitable to absorb energy and sound to result in significant reduction in: a) the sound produced by practice drumming, and b) physical damage to any surface struck by the practice drumstick.

4 Claims, 2 Drawing Sheets

PRACTICE DRUMSTICK

STATEMENT REGARDING FEDERAL SPONSORSHIP

No invention claimed in this application was made under Federally sponsored research or development.

CROSS REFERENCE TO RELATED APPLICATIONS

There are no applications related to this application.

The practice drumstick comprises an inner core and an outer sheath. The outer sheath is constructed of a material or materials suitable to absorb energy and sound to result in significant reduction in: a) the sound produced by practice drumming, and b) physical damage to any surface struck by the practice drumstick. Such materials include but are not limited to plastic foams. The inner core is constructed of metal, plastic or other material having suitable strength such that when combined with the outer sheath the resulting drumstick retains the feel and shape of a typical drumstick.

BACKGROUND OF INVENTION

Drummers have long sought a drumstick which can be used to practice and perfect their art with a minimum of unwanted noise and damage to struck surfaces while retaining the handling characteristics of drumsticks used in live performances. It is the objective of the present invention to provide a durable practice drumstick which significantly reduces noise and damage from practice drumming while maintaining the handling characteristics of performance drumsticks used in performances.

The current pool of choices to accomplish these four objectives falls into two major groups: Drumsticks designed with sound deadening and impact damage reducing material provided over a portion of the stick, and Drumsticks provided with inner cores covered by outer sheaths of high durability materials.

Published U.S. Patent application 20040244563 to Calato, and U.S. Pat. No. 5,170,001 to Amendola are typical of the partially covered genre of drumstick designs wherein the durability or noise characteristics are achieved through a partial covering of the exterior surface of the drumstick. This approach is inherently unable to accommodate the desire of drummers to use all areas of the drumstick to achieve various desired effects.

U.S. Pat. No. 5,179,237 to Grossman, U.S. Pat. No. 5,602,355 to Lipp, and U.S. Pat. No. 5,361,671 to Genna, are typical of the Genre of drumsticks made with cores and sheaths wherein the sheath material is selected to increase the durability of the drumstick. While this approach often enhances the durability of the drumstick is does little to reduce the noise produced during practice drumming or the damage resulting to practice surfaces.

BRIEF SUMMARY OF THE INVENTION

The practice drumstick comprises an inner core and an outer sheath. The outer sheath is constructed of a material or materials suitable to absorb energy and sound to result in significant reduction in: a) the sound produced by practice drumming, and b) physical damage to any surface struck by the practice drumstick. Such materials include but are not limited to plastic foams. The inner core is constructed of metal, plastic or other material having suitable strength such that when combined with the outer sheath the resulting drumstick retains the feel and shape of a typical drumstick. While it has been found that a diameter of approximately 3/16 of an inch for the inner core combined with an outside diameter of 5/8 of an inch for the outer sheath provides the desired results, many other combinations provide satisfactory results.

Drumsticks typically include a tip at one end and a butt at the other end with a central region connects the two. It is worthy of note that in typical use any portion of the drumstick may be used to strike a surface. The selection of the area with which to strike and of the surface to strike is made by the drummer with both the resulting timing between strikes and the sound made by the strike in mind to achieve the desired effect.

In one embodiment the central region is cylindrical in shape and provides both covering for the inner core and connection or continuity between the first and second ends. In other embodiments the central region may be a conical section, or any combination of cylindrical and conical sections.

DETAILED DESCRIPTION

Figure 1:
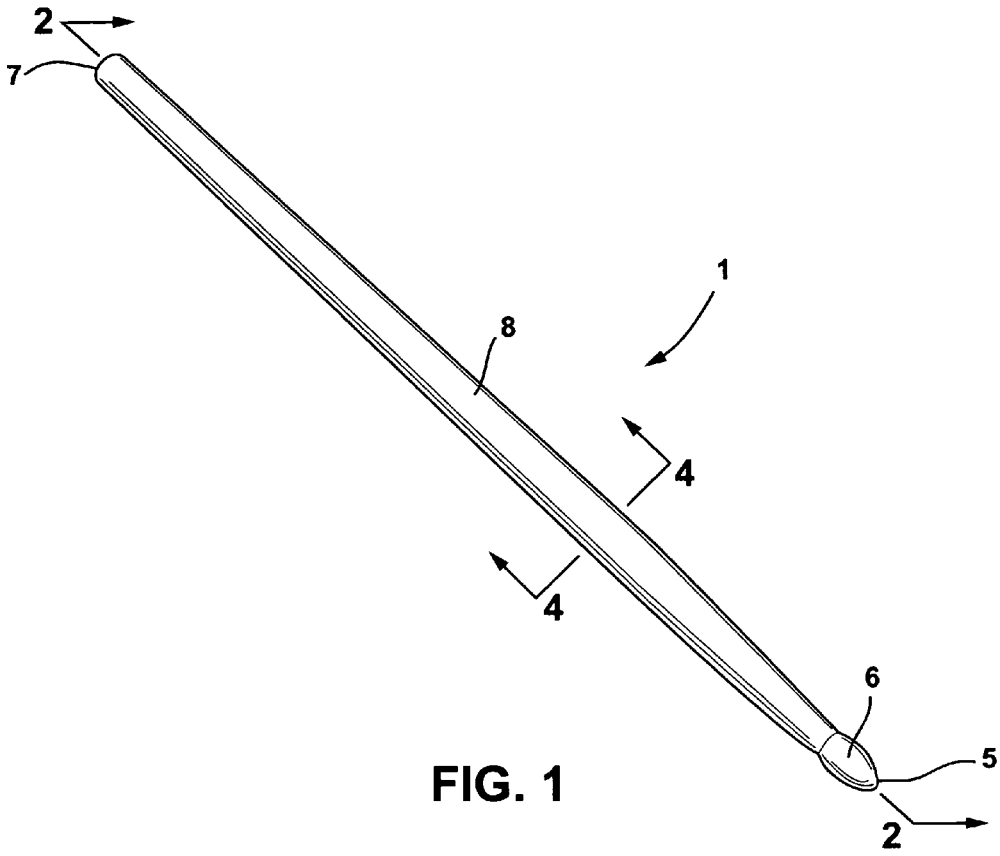
FIG. 1 is a perspective view of the practice drumstick.
Figure 2:
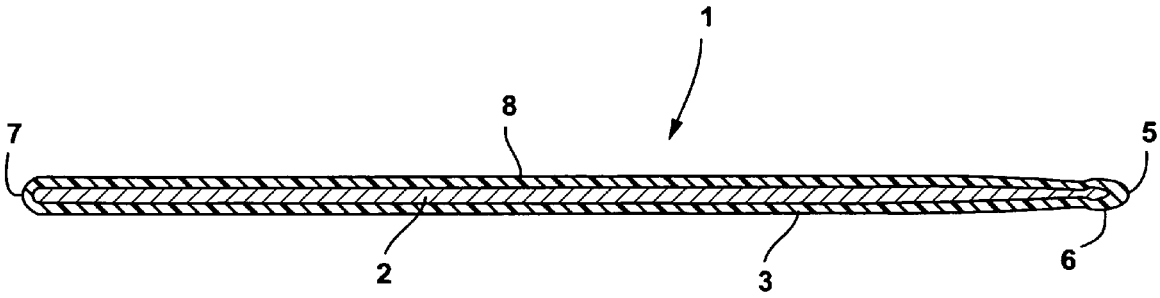
FIG. 2 is a longitudinal section view of the practice drumstick.
Figure 3:
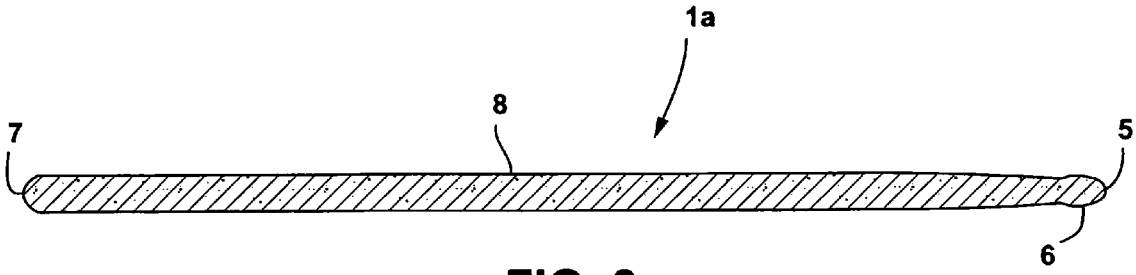
FIG. 3 Prior Art
FIG. 3 is a cut away view of a prior art drumstick.
Figure 4:
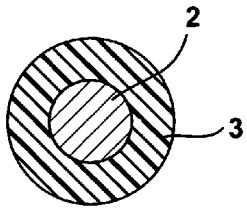
FIG. 4 is a cross section view of the practice drumstick.
Figure 5:
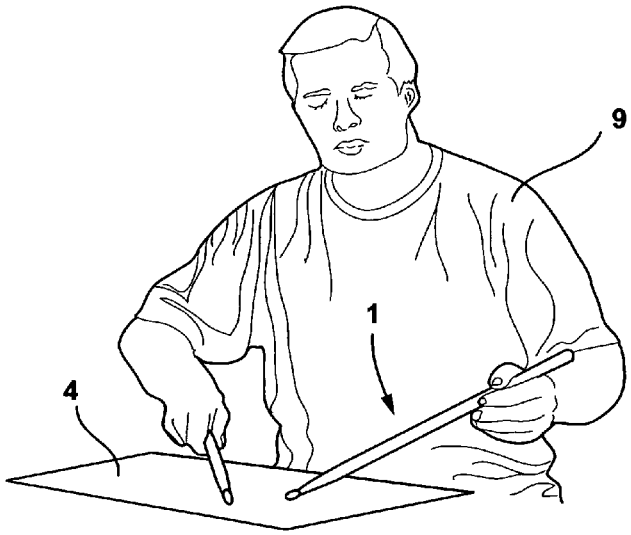
FIG. 5 is an illustration of the practice drumstick in use.

The practice drumstick 1 comprises an inner core 2 and an outer sheath 3. The outer sheath 3 is constructed of material suitable to absorb energy and sound to result in significant reduction in: a) the sound produced by practice drumming, and b) physical damage to any surface 4 struck by the practice drumstick 1. Such materials include but are not limited to plastic foams. The inner core 2 is constructed of metal, plastic or other material having suitable strength such that when combined with the outer sheath 3 the resulting drumstick 1 retains the feel and shape of a typical drumstick 1*a*. While it has been found that a diameter of approximately 3/16 of an inch for the inner core 2 combined with an outside diameter of 5/8 of an inch for the outer sheath provides the desired results, many other combinations provide satisfactory results.

The first end 5 may be hemispherical in shape or may be a combination of hemispherical and cylindrical in either case the hemispherical portion 6 is positioned at the extreme of the first end 5 of the practice drumstick 1. The first end 5 of the outer sheath 3 provide one of three regions of the practice drumstick 1 with which the user may strike a surface 4 serving as drumming surface 4. The first end 5 is often referred to as the tip of the practice drumstick 1. Assuring that the inner core 2 penetrates approximately 50 percent into the first end 5 provides for satisfactory wear characteristics.

The second end 7 is typically tapered and rounded providing a more conical shape than the first end 5. However the second end 7 may assume any shape advantageous to the user providing that the second end 7 is either a part of the sheath, or is attached to the central region 8 to work in combination with the central region 8 and first end 5 to completely surround the inner core 2. The second end 7 is often referred to as the butt of the practice drumstick 1. Assuring that the inner core 2 penetrates approximately 50 percent into the second end 7 provides for satisfactory wear characteristics.

In one embodiment the central region 8 is cylindrical in shape and provides both covering for the inner core 2 and connection or continuity between the first and second ends 7. In other embodiments the central region 8 may be a conical section, or any combination of cylindrical and conical sections.

The outer sheath 3 comprises the first end 5, second end 7, and central region 8. The outer sheath 3 completely surrounds the inner core 2 to provide reduction in sound level and surface 4 damage, whenever a user strikes a practice surface 4 using any portion of the practice drumstick 1.

A drummer 9 uses the practice drumstick 1 in place of an ordinary drumstick 1 whenever there is a need to practice drumming under circumstances where the sound produced by such practice is to be reduced. Further, a drummer 9 uses the practice drumstick 1 whenever there is a need to reduce or avoid damage to a surface 4 or objects the drummer 9 might strike while drumming.

The outer sheath 3 may be constructed of any number of parts resulting in a structure which completely surrounds the inner core 2 and provides both a first and second end 7 as described above. Specifically it will be recognized that the outer sheath 3 may include two parts instead of three wherein a single attachment is necessary to assemble the outer sheath 3 to completely surround the inner core 2. Similarly it will be recognized that the central region 8 may be subdivided to provide any number of attachments to assemble the outer sheath 3 to surround the inner core 2. It will be further appreciated that the entire outer sheath 3 may be composed of a single piece molded over the inner core 2 or that the outer sheath 3 may be provided with a longitudinal slit through which the inner core 2 may be inserted with the slit then sealed to complete the outer sheath 3 surrounding the inner core 2.

I claim:

1. A practice drumstick comprising:

a) An inner core; and b) An outer sheath fully encapsulating said inner core.

2. A practice drumstick comprising:

a) An inner core; and b) An outer sheath fully encapsulating said inner core, wherein said outer sheath is composed of sound absorbent material.

3. A practice drumstick comprising:

a) An inner core; and b) An outer sheath fully encapsulating said inner core, wherein said outer sheath is composed of an energy absorbent material selected to limit damage to any surface which is struck by said practice drumstick.

4. The practice drumstick of claim 3 wherein said outer sheath is composed of sound absorbent material.

* * * * *